US009137869B2

(12) United States Patent
Furukawa et al.

(10) Patent No.: US 9,137,869 B2
(45) Date of Patent: Sep. 15, 2015

(54) ILLUMINATION APPARATUS AND LIGHTING CIRCUIT

(71) Applicant: PANASONIC INTELLECTUAL PROPERTY MANAGEMENT CO., LTD., Osaka (JP)

(72) Inventors: Satoshi Furukawa, Aichi (JP); Akira Takahashi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/595,515

(22) Filed: Jan. 13, 2015

(65) Prior Publication Data

US 2015/0208477 A1 Jul. 23, 2015

(30) Foreign Application Priority Data

Jan. 22, 2014 (JP) ..... 2014-009734

(51) Int. Cl.
*H05B 33/08* (2006.01)

(52) U.S. Cl.
CPC ..... *H05B 33/0827* (2013.01)

(58) Field of Classification Search
None
See application file for complete search history.

(56) References Cited

U.S. PATENT DOCUMENTS

| | | | | |
|---|---|---|---|---|
| 4,500,775 | A * | 2/1985 | Sangu et al. | 219/497 |
| 4,552,102 | A * | 11/1985 | Egle | 123/179.21 |
| 4,673,456 | A * | 6/1987 | Spencer et al. | 156/345.36 |
| 4,775,821 | A * | 10/1988 | Sikora | 315/219 |
| 4,779,027 | A * | 10/1988 | Sikora | 315/127 |
| 2010/0301761 | A1* | 12/2010 | Liao et al. | 315/186 |
| 2012/0104957 | A1* | 5/2012 | Yano et al. | 315/201 |
| 2014/0346954 | A1* | 11/2014 | Li et al. | 315/121 |
| 2015/0077000 | A1 | 3/2015 | Takahashi et al. | |
| 2015/0077001 | A1 | 3/2015 | Takahashi et al. | |
| 2015/0077002 | A1 | 3/2015 | Takahashi et al. | |

FOREIGN PATENT DOCUMENTS

JP 2013-004960 1/2013

* cited by examiner

*Primary Examiner* — Crystal L Hammond
(74) *Attorney, Agent, or Firm* — Greenblum & Bernstein, P.L.C.

(57) ABSTRACT

An illumination apparatus includes a light emitting unit having at least one first light emitting element and at least one second light emitting element connected in series with each other. Further, the illumination apparatus includes a keying circuit for electrically closing a first power supply path which passes through both the first and the second light emitting element from the power supply circuit or the capacitive element or a second power supply path which passes through the first light emitting element without passing through the second light emitting element from the capacitive element. The keying circuit is set in a state in which the first power supply path is electrically closed during a power supply, and is set in a state in which the second power supply path is electrically closed when a reduction in quantity of charges of the capacitive element is detected after the power supply is stopped.

16 Claims, 11 Drawing Sheets

ILLUMINATION APPARATUS AND LIGHTING CIRCUIT

CROSS-REFERENCE TO RELATED APPLICATION

This application claims priority to Japanese Patent Application No. 2014-9734 filed on Jan. 22, 2014, the entire contents of which are incorporated herein by reference.

TECHNICAL FIELD

The present disclosure relates to an illumination apparatus and a lighting circuit using a semiconductor light emitting element as a light source, and more particularly to an illumination apparatus and a lighting circuit for providing an afterglow.

BACKGROUND ART

From the viewpoint of energy saving, an illumination apparatus using a light emitting diode (LED) as a light source is becoming widely used. However, since the LED has a short afterglow characteristic, a space around the illumination apparatus becomes dark immediately when the power supply to the illumination apparatus from an external power source stops. Thus, an illumination apparatus which can emit an afterglow for a few seconds or minutes after stopping the power supply to the illumination apparatus from an external power source has been proposed (see, e.g., Japanese Unexamined Patent Application Publication No. 2013-4960).

FIG. 12 is a diagram showing a circuit configuration of an illumination apparatus 900 disclosed in Japanese Unexamined Patent Application Publication No. 2013-4960. The illumination apparatus 900 includes two light emitting modules 911 and 912 using LEDs as a light source, a constant current output circuit 921, two capacitive elements 922 and 924, a diode 923, a zener diode 925 and a resistor 926.

In the illumination apparatus 900, during normal lighting in which power is supplied to the constant current output circuit 921 from the external power source, as shown by a solid arrow in FIG. 12, first, the capacitive element 922 for ripple suppression is charged from the constant current output circuit 921. When charging to the capacitive element 922 is completed, power is supplied to the light emitting module 911 and the light emitting module 911 is turned on. When the power is supplied to the light emitting module 911, as shown by another solid arrow in FIG. 12, charging to the capacitive element 924 through the diode 923 is also performed.

On the other hand, when the power supply to the constant current output circuit 921 from the external power source is stopped, the power supply to the light emitting module 911 and the capacitive elements 922 and 924 from the constant current output circuit 921 is not performed. However, as shown by a dashed arrow in FIG. 12, the charges accumulated in the capacitive element 924 flow to the light emitting module 912 and the light emitting module 912 is turned on. Thus, even after the power supply to the constant current output circuit 921 from the external power source is stopped, while the charges remain in the capacitive element 924, the light emitting module 912 can be turned on by using the charges. Therefore, light emitted from the light emitting module 912 can be used as an afterglow.

In the illumination apparatus according to Japanese Unexamined Patent Application Publication No. 2013-4960, in addition to a capacitive element for suppressing the ripple current used in normal lighting, it is necessary to further provide a capacitive element used as a power source for providing the afterglow. Since the capacitive element is a relatively large component among the circuit components, it is preferable to reduce the size of the illumination apparatus by reducing the number of capacitive elements as much as possible. In particular, it is expected that the illumination apparatus using LEDs as a light source will replace a conventional illumination light source such as an incandescent bulb, a fluorescent lamp, and a high-pressure discharge lamp. Therefore, miniaturization of the illumination apparatus is important in terms of increasing conformity with the existing luminaire.

SUMMARY OF THE INVENTION

In view of the above, the present disclosure provides an illumination apparatus using a semiconductor light emitting element as a light source, capable of emitting an afterglow after power supply from an external power source is stopped, while reducing the size of the apparatus, and a lighting circuit thereof.

In accordance with a first aspect of the present invention, there is provided an illumination apparatus including a power supply circuit, a capacitive element connected between output terminals of the power supply circuit, a light emitting unit including at least one first semiconductor light emitting element and at least one second semiconductor light emitting element connected with the at least one first semiconductor light emitting element in series, and a keying circuit provided between the capacitive element and the light emitting unit and configured to electrically open or close a first power supply path which passes through both the at least one first semiconductor light emitting element and the at least one second semiconductor light emitting element from the power supply circuit or the capacitive element, and a second power supply path which passes through the at least one first semiconductor light emitting element without passing through the at least one second semiconductor light emitting element from the capacitive element. The keying circuit is set in a first state in which the first power supply path is electrically closed and the second power supply path is electrically opened while a power from the power supply circuit is being supplied, and is set in a second state in which the first power supply path is electrically opened and the second power supply path is electrically closed when a reduction in quantity of charges of the capacitive element is detected after the power supplied from the power supply circuit is stopped.

In the illumination apparatus, the keying circuit may include a detection unit configured to detect the reduction in quantity of charges of the capacitive element, and a state selection unit configured to electrically open or close at least one electrical connection path provided between the at least one first semiconductor light emitting element and the at least one second semiconductor light emitting element, and wherein as the reduction in quantity of charges is detected by the detection unit, the state selection unit may change the electrical connection path from a closed state to a open state to switch the keying circuit from the first state to the second state.

Preferably, the detection unit includes a first switching element whose control terminal is connected to a positive electrode of the capacitive element and which is turned off with the reduction in quantity of charges of the capacitive element, and the state selection unit includes a second switching element including a control terminal connected to the positive electrode of the capacitive element and a terminal connected to the electrical connection path, and which is turned on with transition from a conduction state to a non-conduction state of the first switching element.

Further, the positive electrode of the capacitive element may be connected to a terminal of the first switching element and the control terminal of the second switching element.

It is preferred that the first switching element is one of an npn-type bipolar transistor whose collector is connected to the positive electrode of the capacitive element and whose emitter is connected to a ground, and an n-type field effect transistor whose drain is connected to the positive electrode of the capacitive element and whose source is connected to the ground, and the second switching element is one of an npn-type bipolar transistor whose collector is connected to the electrical connection path and whose emitter is connected to the ground, and an n-type field effect transistor whose drain is connected to the electrical connection path and whose source is connected to the ground.

Further, the keying circuit may further include a first resistive element having one end connected to the positive electrode of the capacitive element and the other end connected to the control terminal of the first switching element, a second resistive element having one end connected to the other end of the first resistive element and the other end connected to a ground, a third resistive element having one end connected to the positive electrode of the capacitive element and the other end connected to a terminal of the first switching element, and a fourth resistive element provided between the electrical connection path and the terminal of the second switching element.

It is preferred that the first semiconductor light emitting element and the second semiconductor light emitting element have the same forward drop voltage, and when a resistance value of the first resistive element is $r_1$, a resistance value of the second resistive element is $r_2$, the total number of the first semiconductor light emitting element and the second semiconductor light emitting element is N, a minimum forward drop voltage of the first semiconductor light emitting element and the second semiconductor light emitting element is $V_{fmin}$, and an operating voltage of the first switching element is $V_{TR1}$, in case of the first power supply path, a relationship of $(r_2/(r_1+r_2))\times N\times V_{fmin}>V_{TR1}$ is satisfied.

Further, it is preferred that the first semiconductor light emitting element and the second semiconductor light emitting element have the same forward drop voltage, and when a resistance value of the first resistive element is a resistance value of the second resistive element is $r_2$, the number of the first semiconductor light emitting element is n, and a maximum forward drop voltage of the first semiconductor light emitting element is $V_{fmax}$, in case of the second power supply path, a relationship of $(r_2/(r_1+r_2))\times n\times V_{fmax}<V_{TR1}$ is satisfied.

Further, the keying circuit may further include a zener diode having a cathode connected to the positive electrode of the capacitive element and an anode connected to the control terminal of the first switching element, a first resistive element having one end connected to the anode of the zener diode and the other end connected to ground, a second resistive element having one end connected to the positive electrode of the capacitive element and the other end connected to a terminal of the first switching element, and a third resistive element provided between the electrical connection path and the terminal of the second switching element.

The detection unit may also serve as the state selection unit In the keying circuit, and the keying circuit may further include a first resistive element having one end connected to the positive electrode of the capacitive element, a switching element whose first terminal serving as a control terminal is connected to the other end of the first resistive element, whose second terminal is connected to a cathode of the second semiconductor light emitting element which is arranged at the most downstream of the first power supply path, and whose third terminal is connected to a ground, a second resistive element having one end connected to the other end of the first resistive element and the other end connected to the ground, and a third resistive element having one end connected to the electrical connection path and the other end connected to the ground. Further, the switching element may be turned off with the reduction in quantity of charges of the capacitive element, and the electrical connection path is changed from the closed state to the open state with transition from a conduction state to a non-conduction state of the switching element.

Preferably, the number of the at least one first semiconductor light emitting element is different from the number of the at least one second semiconductor light emitting element. Further, the number of the at least one first semiconductor light emitting element may be smaller than the number of the at least one second semiconductor light emitting element.

It is preferred that a color temperature of light emitted from the first semiconductor light emitting element is different from a color temperature of light emitted from the second semiconductor light emitting element.

Further, the at least one first semiconductor light emitting element may include a plurality of first semiconductor light emitting elements connected in series, and the plurality of first semiconductor light emitting elements may be arranged annularly to surround the at least one second semiconductor light emitting element, and a main emission direction of the plurality of first semiconductor light emitting elements may be oriented outwardly with respect to a virtual line which extends in a main emission direction of the at least one second semiconductor light emitting element.

In accordance with another aspect of the present invention, there is provided a lighting circuit of an illumination apparatus using a light emitting unit including at least one first semiconductor light emitting element and at least one second semiconductor light emitting element connected with the at least one first semiconductor light emitting element in series as a light source. The lighting circuit includes a power supply circuit, a capacitive element connected between output terminals of the power supply circuit, and a keying circuit provided between the capacitive element and the light emitting unit and configured to electrically open or close a first power supply path which passes through both the at least one first semiconductor light emitting element and the at least one second semiconductor light emitting element from the power supply circuit or the capacitive element, and a second power supply path which passes through the at least one first semiconductor light emitting element without passing through the at least one second semiconductor light emitting element from the capacitive element. Further, the keying circuit is set in a first state in which the first power supply path is electrically closed and the second power supply path is electrically opened while a power from the power supply circuit is being supplied, and is set in a second state in which the first power supply path is electrically opened and the second power supply path is electrically closed when a reduction in quantity of charges of the capacitive element is detected after the power supplied from the power supply circuit is stopped.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

First Embodiment

[Overall Configuration of Illumination Apparatus 1]

Figure 1:
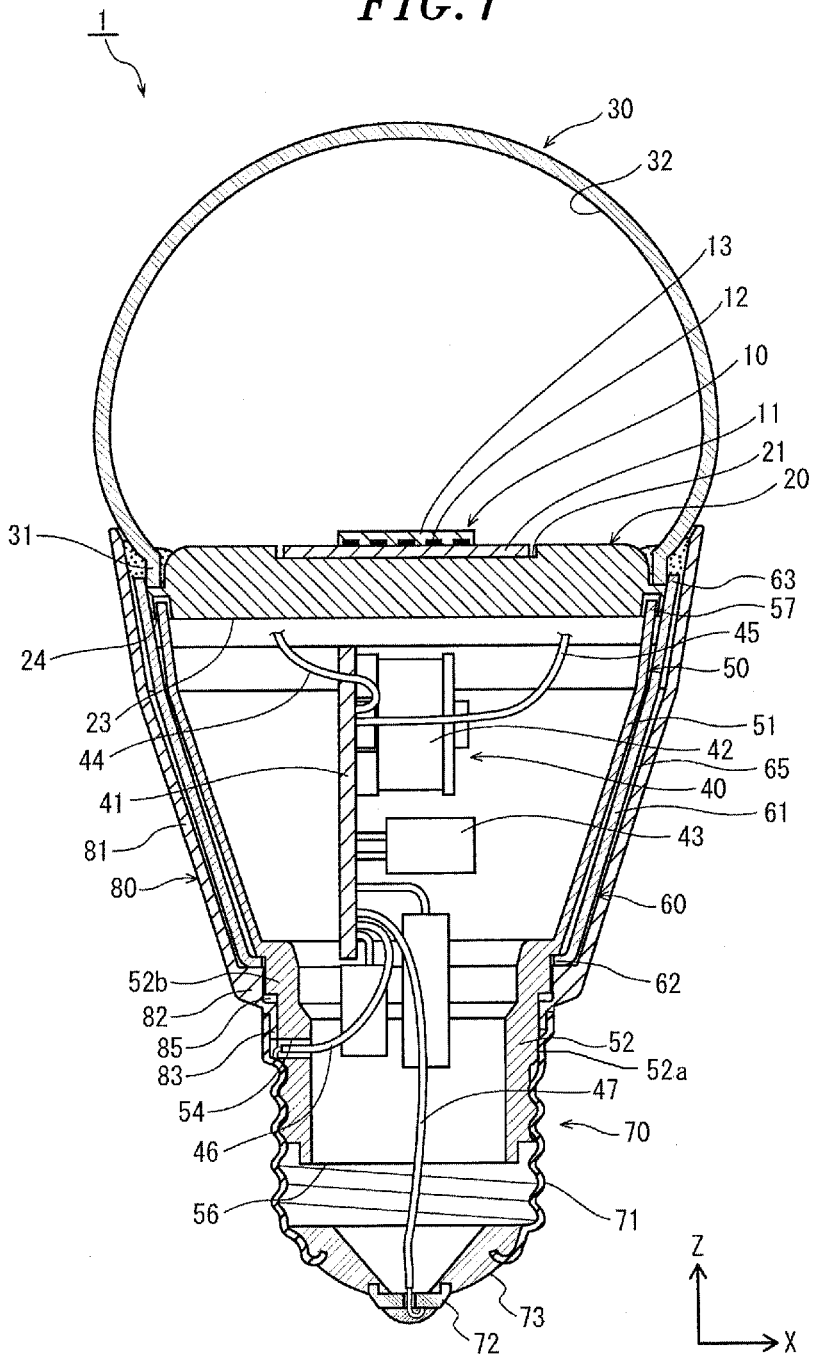
FIG. 1 is a longitudinal cross-sectional view of an illumination apparatus 1 according to an embodiment.

FIG. 1 is a longitudinal cross-sectional view of an illumination apparatus 1 according to a first embodiment. The illumination apparatus 1 is an LED lamp as a replacement of, e.g., an incandescent bulb. The illumination apparatus 1 includes a light emitting module 10, a base 20, a globe 30, a lighting circuit unit 40, a circuit holder 50, an inner casing 60, a cap 70 and an outer casing 80.

[Configuration of Parts]

<Light Emitting Module 10>

The light emitting module 10 serving as a light emitting unit includes a mounting board 11, LEDs 12 and a sealing member 13. As the mounting board 11, for example, a conventional mounting board such as a resin board, a ceramic board, or a metal-based board made of a resin plate and a metal plate may be used.

The LEDs 12 serve as a light source of the illumination apparatus 1. A plurality of LEDs 12 are mounted on an upper surface of the mounting board 11 by using Chip on Board (COB) technology. As the LEDs 12, for example, GaN-based LEDs emitting blue light are used. The LEDs 12 include LEDs used both during a normal lighting when power is supplied from an external power source and during an afterglow immediately after the power supply from the external power source is stopped, and LEDs used only during the normal lighting.

Hereinafter, the LEDs used both during the normal lighting and the afterglow are referred to as "afterglow LEDs" and the LEDs used only during the normal lighting are referred to as "normal lighting LEDs." The light emitting module 10 includes a plurality of afterglow LEDs and a plurality of normal light LEDs. The afterglow LEDs correspond to first semiconductor light emitting elements, and the normal lighting LEDs correspond to second semiconductor light emitting elements. In FIG. 1, the first and the second light emitting elements are denoted by reference numeral 12 without distinguishing between them.

The sealing member 13 is provided on the mounting board 11 to cover the entire LEDs 12. The sealing member 13 is formed of a light transmitting material which is mixed with a wavelength conversion material. As the light transmitting material, for example, a silicone resin may be used. The wavelength conversion material converts blue light emitted from the LEDs 12 into yellow light and, for example, yellow phosphor particles may be used as the wavelength conversion material.

<Base 20>

The base 20 has a substantially disk shape, and the light emitting module 10 is placed substantially at the center of an upper surface 21 of the base 20. In the base 20, through holes (not shown) through which a pair of lead wires 44 and 45 of the lighting circuit unit 40 pass are formed. Insertion portions 24 into which protrusions 57 of the circuit holder 50 are inserted is formed on a lower surface 23 of the base 20 to restrict a rotational movement of the base 20.

The base 20 is made of, for example, a high thermal conductive material such as a metal material and a high thermal-conductive resin material. The base 20 is manufactured by, e.g., injection molding of the material.

<Globe 30>

The globe 30 is a substantially dome-shaped member formed to cover the light emitting module 10 in a main direction of emission. The globe 30 is made of a light transmitting resin material or glass. By applying an adhesive into a gap between an inner peripheral surface of the outer casing 80 and an outer peripheral surface of the base 20, and inserting an opening-side end 31 of the globe 30 into the adhesive, the base 20, the globe 30 and the outer casing 80 are fixed.

An inner surface 32 of the globe 30 may be subjected to diffusion treatment to diffuse the light emitted from the light emitting module 10. The diffusion treatment may be performed, for example, by applying a white pigment, by coating a composition obtained by mixing a material such as silica, amorphous silica, calcium carbonate, barium sulfate, aluminum hydroxide or titanium oxide with a coating material, or the like.

<Lighting Circuit Unit 40>

The lighting circuit unit 40 is configured to receive power through the cap 70 and drive the LEDs 12 to emit light, and includes a lighting circuit for the illumination apparatus 1 using the light emitting module 10 as a light source. The lighting circuit unit 40 includes, as main components, a circuit board 41, a plurality of components, e.g., electronic components 42 and 43, which are mounted on one main surface (mounting surface) of the circuit board 41, a wiring pattern (not shown) provided on the other main surface (opposite to the mounting surface) of the circuit board 41, and the like.

The lighting circuit has a main function of supplying power to the light emitting module 10, and this function is realized by an electronic circuit including various components, e.g., the electronic components 42 and 43. The lighting circuit includes a constant current output circuit for mainly performing rectifying and smoothing, a capacitive element for mainly suppressing a ripple current, and the like.

The lighting circuit unit 40 and the light emitting module 10 are electrically connected to each other through a pair of the lead wires 44 and 45. The lead wires 44 and 45 are drawn to above the base 20 through the respective through holes of the base 20 from the lighting circuit unit 40 and connected to the light emitting module 10. Further, the lighting circuit unit 40 and the cap 70 are electrically connected through another pair of lead wires 46 and 47. The lead wire 46 is connected to a shell portion 71 of the cap 70 through a through hole 54 provided in a small-diameter portion 52 of the circuit holder 50. In addition, the lead wire 47 is connected to an eyelet 72 of the cap 70 through a lower opening 56 of the small-diameter portion 52 of the circuit holder 50.

<Circuit Holder 50>

The circuit holder 50 is configured to hold the lighting circuit unit 40. The circuit holder 50 includes a large-diameter portion 51 and the small-diameter portion 52, and most of the lighting circuit unit 40 is accommodated in the large-diameter portion 51. The protrusions 57 are formed in the large-diameter portion 51. The protrusions 57 are inserted into the insertion portions 24 of the base 20 so that the circuit holder 50 fits into the base 20.

The cap 70 is externally fitted to the small-diameter portion 52. Also, in an outer peripheral surface 52*a* of the small-diameter portion 52, a protruding portion 52*b* is formed to engage in a recess 85 provided in an annular portion 82 of the outer casing 80 when assembling the illumination apparatus 1. Further, the circuit holder 50 is formed of an electrically insulating material such as a resin material and an inorganic material.

<Inner Casing 60>

The inner casing 60 includes a cylindrical body portion 61 and an annular engaging portion 62 provided to extend from a lower end of the body portion 61. The body portion 61 is externally fitted to the large-diameter portion 51 of the circuit holder 50. The base 20 is fitted into an upper end 63 of the body portion 61. The inner casing 60 is made of a high thermal conductive material such as a metal material and a high thermal-conductive resin material. The inner casing 60 functions as a dissipating member, a so-called heat sink, for dissipating heat generated from the light emitting module 10 during lighting of the illumination apparatus 1 toward the cap 70.

<Cap 70>

The cap 70 is a member for receiving power from a socket of a luminaire when turning on the illumination apparatus 1. The cap 70 is electrically connected to the lighting circuit unit 40 through the lead wires 46 and 47. The cap 70 is attached to close the lower opening 56 of the small-diameter portion 52 of the circuit holder 50. The type of the cap 70 is not particularly limited, but an Edison type cap (E26) is used in this embodiment. The cap 70 has a substantially cylindrical shape, and includes the shell portion 71 whose outer peripheral surface is formed of a male screw, and the eyelet 72 mounted on the shell portion 71 through an insulating portion 73.

<Outer Casing 80>

The outer casing 80 is a tubular member made of an electrically insulating material to cover an outer peripheral surface 65 of the inner casing 60. The outer casing 80 includes a tubular outer shell portion 81 to cover the outer peripheral surface 65 of the inner casing 60, the annular portion 82 provided to extend radially inward from a lower end of the outer shell portion 81, and a tubular insulating portion 83 protruding toward the cap 70 from the inner periphery of the annular portion 82.

The inner casing 60 and the large-diameter portion 51 of the circuit holder 50 are accommodated in the outer shell portion 81. The annular portion 82 presses the engaging portion 62 of the inner casing 60 toward the large-diameter portion 51, thereby fixing the inner casing 60 to the circuit holder 50. The insulating portion 83 is externally fitted to a root portion of the small-diameter portion 52 of the circuit holder 50, and interposed between the cap 70 and the body portion 61 of the inner casing 60 so that electrical insulation between the inner casing 60 and the cap 70 can be ensured.

[Circuit Configuration of the Illumination Apparatus 1]

Figure 2:
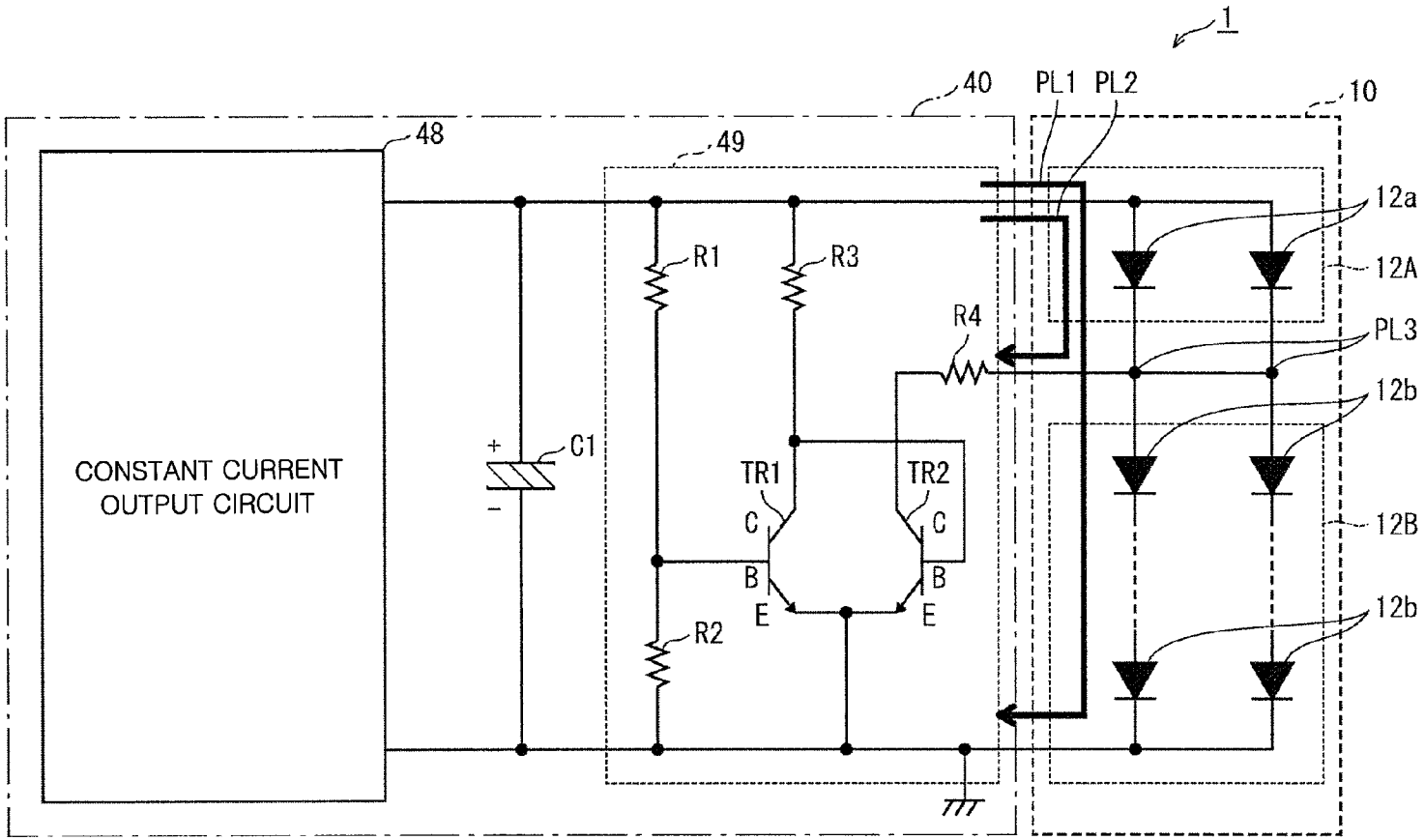
FIG. 2 is a diagram showing a circuit configuration of the illumination apparatus 1 according to the embodiment.

FIG. 2 is a diagram showing a circuit configuration of the illumination apparatus 1 according to the first embodiment. As described above, the illumination apparatus 1 includes the light emitting module 10 serving as a light emitting unit, and the lighting circuit unit 40 including the lighting circuit.

<Light Emitting Module 10>

The light emitting module 10 includes an afterglow LED group 12A having a plurality of afterglow LEDs 12*a* corresponding to first semiconductor light emitting elements, and a normal lighting LED group 12B having a plurality of normal lighting LEDs 12*b* corresponding to second semiconductor light emitting elements. Specifically, the light emitting module 10 includes two series-connected bodies, each having one afterglow LED 12*a* and a plurality of normal lighting LEDs 12*b* connected in series.

<Lighting Circuit Unit 40>

The lighting circuit unit 40 includes a constant current output circuit 48 serving as a power supply circuit, and a capacitive element C1 and a keying circuit 49 connected between output terminals of the constant current output circuit 48.

(Constant Current Output Circuit 48 and Capacitive Element C1)

The constant current output circuit 48 includes a rectifier circuit and the like. An input terminal of the constant current output circuit 48 is connected to an external power source (not shown). When power is supplied to the constant current output circuit 48 from the external power source, the constant current output circuit 48 full-wave rectifies an alternating current supplied from the external power source. The constant current output circuit 48 includes an inductor and a capacitive element (both are not shown). The inductor, the second capacitive element and the capacitive element C1 constitute a smoothing circuit. When power is supplied to the constant current output circuit 48 from the external power source, the smoothing circuit smoothes the current full-wave rectified by the rectifier circuit into a direct current, and outputs the direct current to the keying circuit 49.

Thus, while power is being supplied to the constant current output circuit 48 from the external power source, the capacitive element C1 suppresses a ripple current. On the other hand, when the power supply to the constant current output circuit 48 from the external power source is stopped, the capacitive element C1 discharges electric charges accumulated while power is being supplied from the constant current output circuit 48. The discharged charges are supplied to the afterglow LEDs 12*a*.

(Keying Circuit 49)

The keying circuit 49 is provided in between the capacitive element C1 and the light emitting module 10. As shown in FIG. 2, the keying circuit 49 includes a transistor TR1 serving as a first switching element, a transistor TR2 serving as a second switching element, and first to fourth resistive elements R1, R2, R3 and R4.

One end of the first resistive element R1 is connected to a positive electrode of the capacitive element C1, and the other end of the first resistive element R1 is connected to a base of the transistor TR1. One end of the second resistive element R2 is connected to the other end of the first resistive element R1, and the other end of the second resistive element R2 is connected to the ground and a negative electrode of the capacitive element C1.

The transistor TR1 is an npn-type bipolar transistor, and its base serving as a control terminal is connected to the positive electrode side of the capacitive element C1, more specifically, a connection point between the first resistive element R1 and the second resistive element R2. A collector of the transistor TR1 is connected to the positive electrode side of the capacitive element C1 through the third resistive element R3, and an emitter of the transistor TR1 is connected to the ground. The collector of the transistor TR1 corresponds to one output terminal of the first switching element TR1, and the emitter of the transistor TR1 corresponds to the other output terminal of the first switching element TR1.

One end of the third resistive element R3 is connected to the positive electrode of the capacitive element C1, and the other end of the third resistive element R3 is connected to the collector of the transistor TR1. One end of the fourth resistive element R4 is connected to a connection path PL3 connecting the afterglow LEDs 12*a* and the normal light LEDs 12*b*, and the other end of the fourth resistive element R4 is connected to a collector of the transistor TR2.

The transistor TR2 is an npn-type bipolar transistor, and its base serving as a control terminal is connected to the positive electrode side of the capacitive element C1 through the third resistive element R3. The collector of the transistor TR2 is connected to the connection path PL3 through the fourth resistive element R4, and an emitter of the transistor TR2 is connected to the ground. The collector of the transistor TR2 corresponds to one output terminal of the second switching element TR2, and the emitter of the transistor TR2 corresponds to the other output terminal of the second switching element TR2.

Thus, the keying circuit 49 electrically opens and closes a first power supply path PL1 and a second power supply path PL2. The first power supply path PL1 refers to a power supply path which passes through both the afterglow LEDs 12*a* and the normal lighting LEDs 12*b* from the capacitive element C1. On the other hand, the second power supply path PL2 refers to a power supply path which passes through only the afterglow LEDs 12*a* from the capacitive element C1 without passing through the normal lighting LEDs 12*b*.

The keying circuit 49 operates schematically as follows. While power is being supplied to the capacitive element C1 from the constant current output circuit 48, the keying circuit 49 is set in a first state in which the first power supply path PL1 is closed and the second power supply path PL2 is opened. Then, as the power supply to the capacitive element C1 from the constant current output circuit 48 is stopped and the quantity of electric charges of the capacitive element C1 is reduced, the keying circuit is switched from the first state to a second state in which the first power supply path PL1 is opened and the second power supply path PL2 is closed.

The keying circuit 49 includes a detection unit for detecting a reduction in quantity of charges of the capacitive element C1 due to the stop of the power supply to the capacitive element C1 from the constant current output circuit 48, and an opening and closing unit (state selection unit) for opening and closing the connection path PL3 connecting between the afterglow LEDs 12*a* and the normal lighting LEDs 12*b*. As the reduction in quantity of charges of the capacitive element C1 is detected by the detection unit, the opening and closing unit changes the connection path PL3 from a closed state to an open state to switch the keying circuit 49 from the first state to the second state.

The detection unit mainly includes the transistor TR1, and the function as a detection unit is realized by the transistor TR1. Further, the opening and closing unit mainly includes the transistor TR2, and the function as the opening and closing unit is realized by the transistor TR2.

[Operation of the Keying Circuit 49]

The operation of the keying circuit 49 will be described with reference to FIGS. 2 to 7.

<While Power is Being Supplied from the External Power Source>

Figure 3:
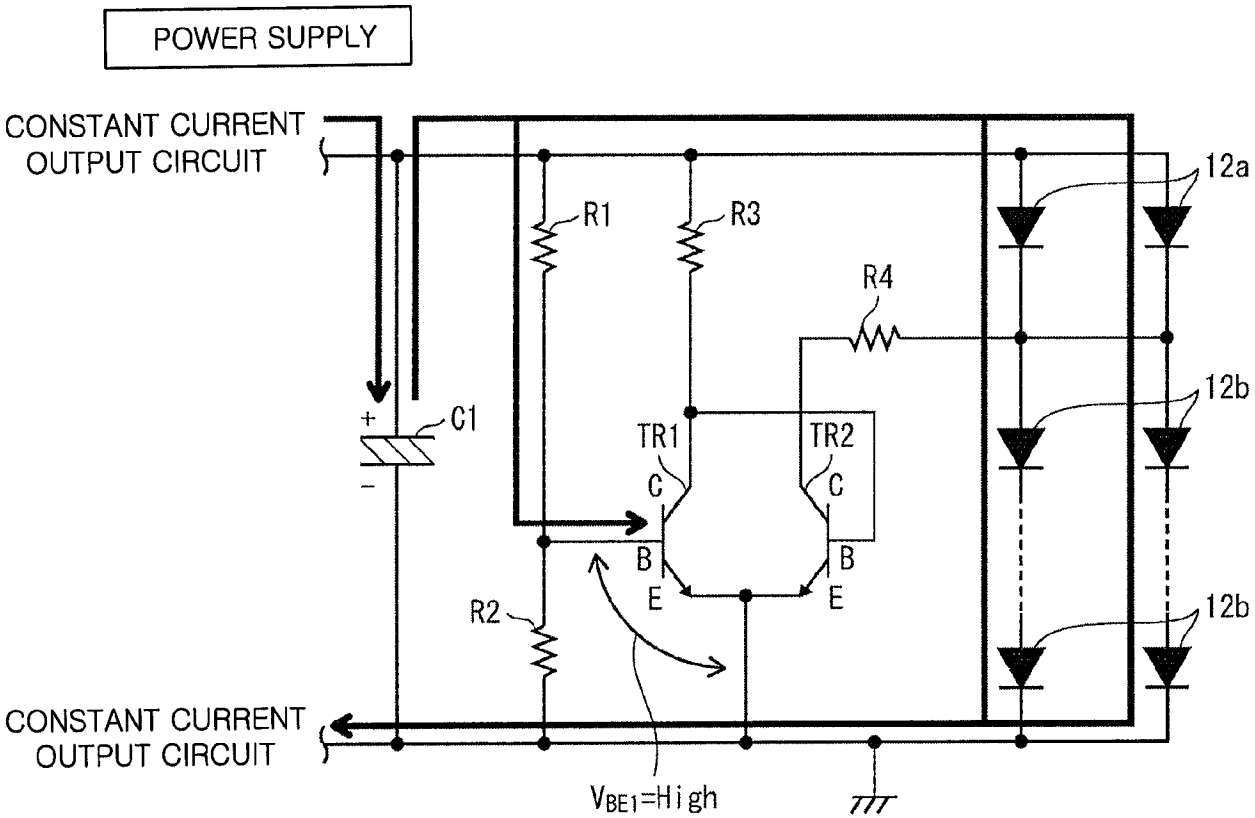
FIGS. 3 and 4 are diagrams for explaining an operation of a keying circuit 49 while power is supplied to the illumination apparatus 1 from an external power source.
Figure 4:
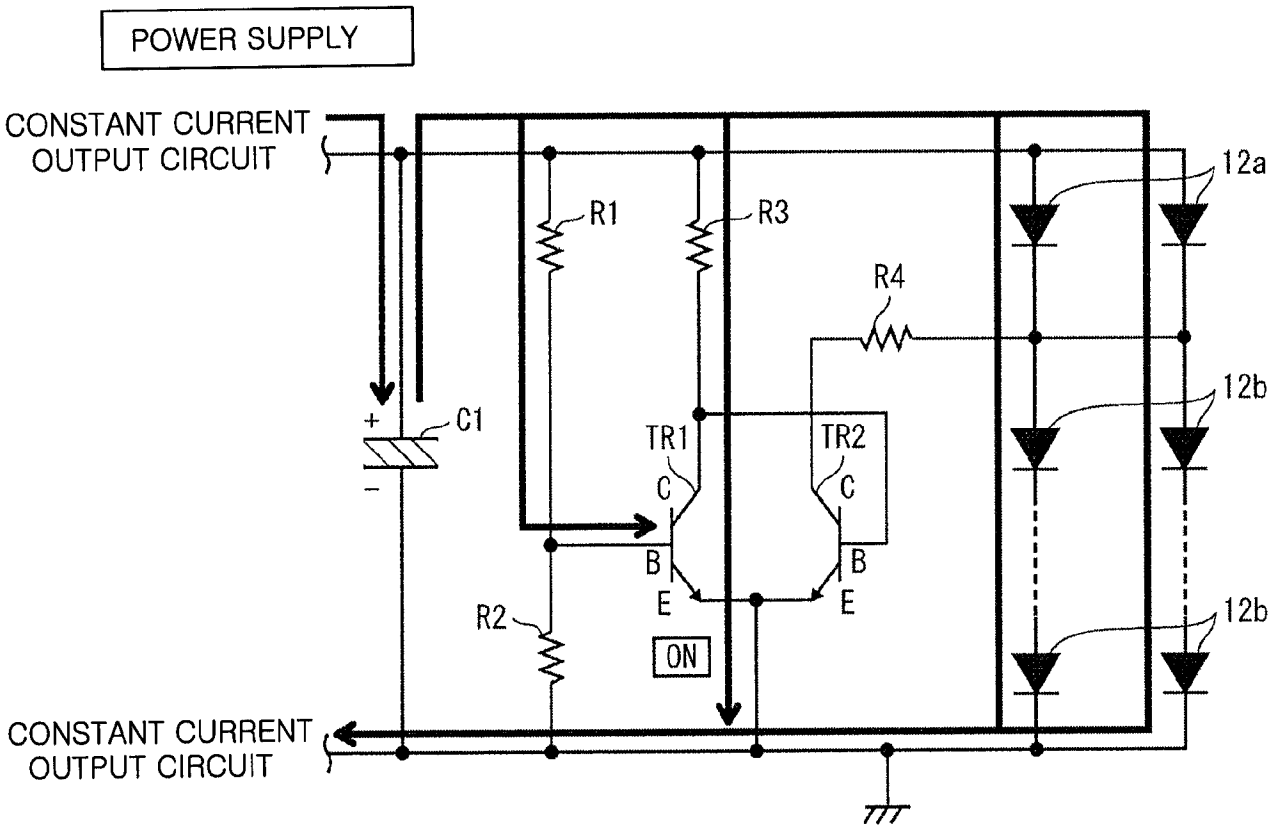

FIGS. 3 and 4 are diagrams for explaining the operation of the keying circuit 49 while power is being supplied to the illumination apparatus 1 from the external power source.

When the power supply to the illumination apparatus 1 from the external power source is started, first, as shown by a solid arrow in FIG. 3, the constant current output circuit 48 starts the power supply and the capacitive element C1 is charged. When the capacitive element C1 is charged, power is supplied to the afterglow LEDs 12*a* and the normal lighting LEDs 12*b*. While power is being supplied from the constant current output circuit 48, the keying circuit 49 electrically closes the first power supply path PL1 and opens the second power supply path PL2 so that the current flows to both the afterglow LEDs 12*a* and the normal lighting LEDs 12*b*.

With the power supply, in addition to the afterglow LEDs 12*a* and the normal lighting LEDs 12*b*, the current also flows to the base of the transistor TR1 through the first resistive element R1. Accordingly, a base-emitter voltage $V_{BE1}$ of the transistor TR1 becomes a high level, and the transistor TR1 is turned on as shown in FIG. 4. When the transistor TR1 is in an ON state, since a conductive state is formed between the base and the emitter of the transistor TR1, the transistor TR2 becomes an OFF state.

<After the Stop of Power Supply from the External Power Source>

Figure 5:
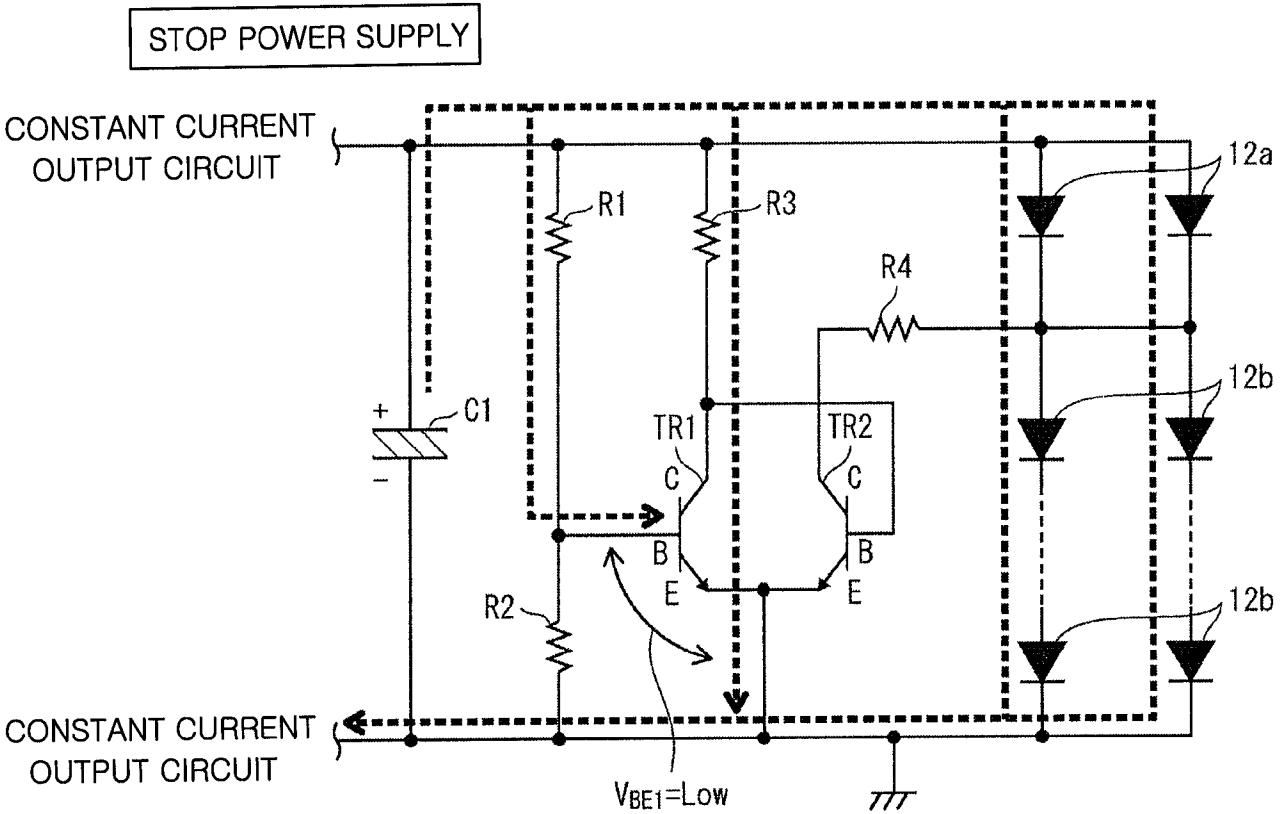
FIGS. 5 to 7 are diagrams for explaining the operation of the keying circuit 49 after the power supply to the illumination apparatus 1 from the external power source is stopped.
Figure 6:
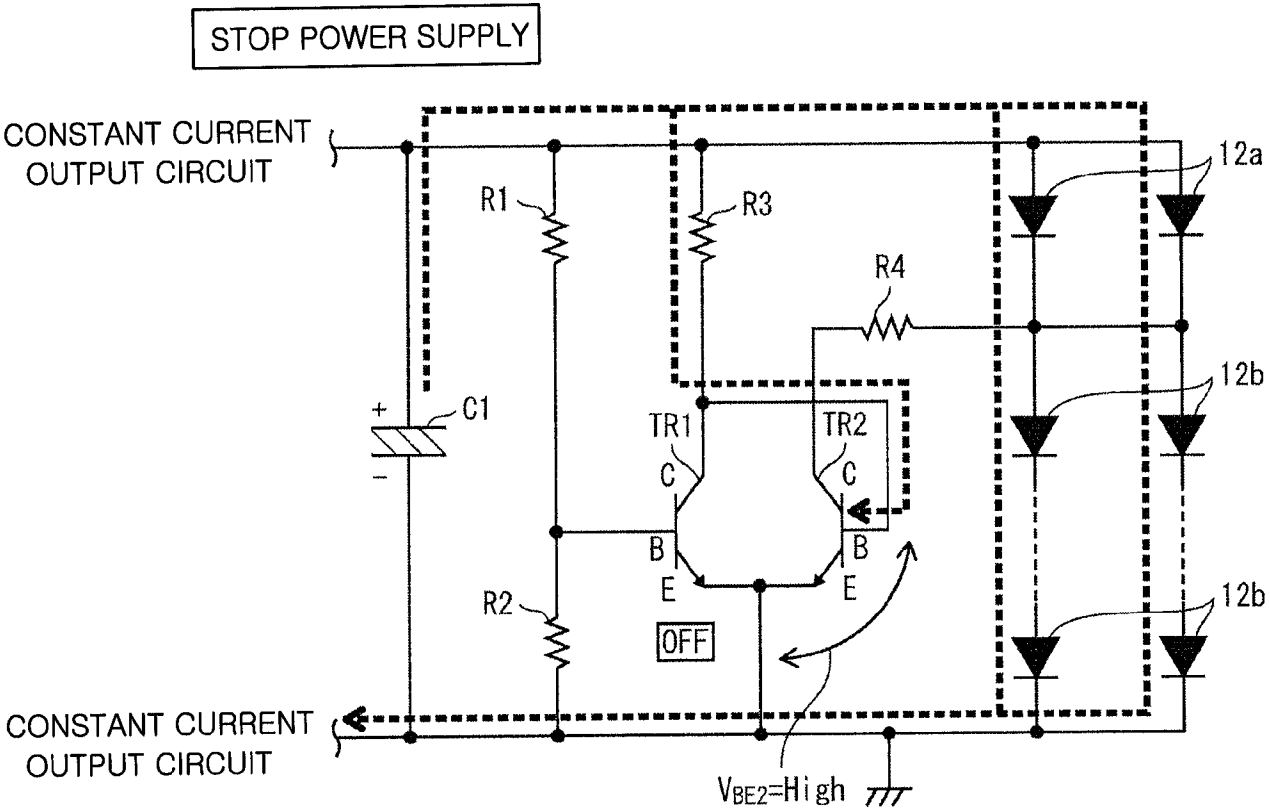
Figure 7:
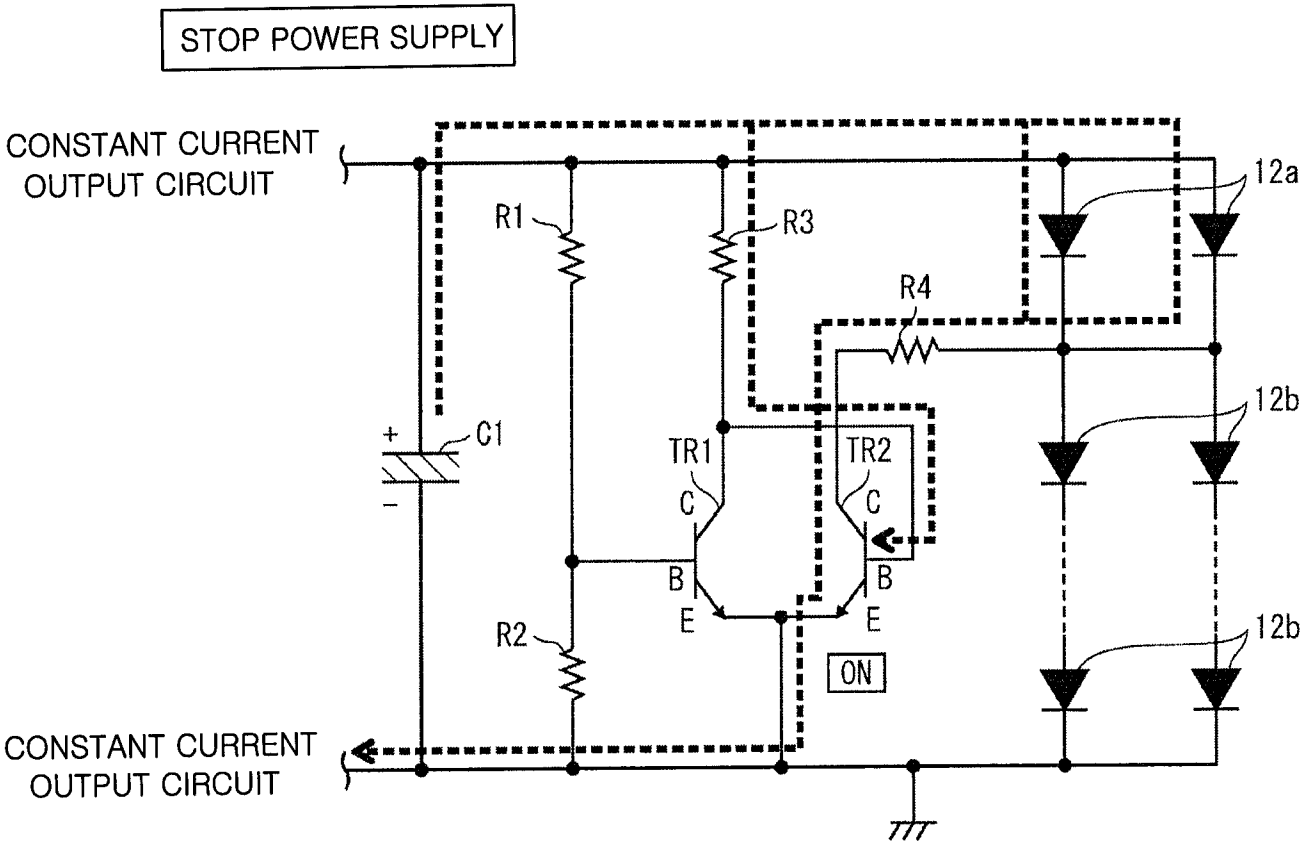

FIGS. 5 to 7 are diagrams for explaining the operation of the keying circuit 49 after the power supply to the illumination apparatus 1 from the external power source is stopped. As shown by a dashed arrow in FIG. 5, when the power supply to the illumination apparatus 1 from the external power source is stopped, the capacitive element C1 starts to discharge the charges accumulated during the power supply from the constant current output circuit 48.

However, since the power supply to the capacitive element C1 from the constant current output circuit 48 is stopped, the quantity of charges of the capacitive element C1 is reduced, and the current flowing to the base of the transistor TR1 is also reduced. Then, the base-emitter voltage $V_{BE1}$ of the transistor TR1 becomes a low level, and the transistor TR1 becomes an OFF state as shown in FIG. 6. That is, since the base of the transistor TR1 is connected to the positive electrode side of the capacitive element C1, the transistor TR1 detects a reduction in quantity of charges of the capacitive element C1. Thus, the transistor TR1 is turned off as the quantity of charges of the capacitive element C1 is reduced.

As shown in FIGS. 2 and 6, the positive electrode of the capacitive element C1 is connected to the collector of the transistor TR1 and the base of the transistor TR2 through the third resistive element R3. Thus, when the transistor TR1 is turned off and a non-conductive state is formed between the collector and the emitter of the transistor TR1, the current flows to the base of the transistor TR2. Accordingly, a base-emitter voltage $V_{BE2}$ of the transistor TR2 becomes a high level, and the transistor TR2 is turned on as shown in FIG. 7. By this circuit configuration, the transistor TR2 is turned on as the transistor TR1 transitions from the ON state to the OFF state.

As the power supply to the capacitive element C1 from the constant current output circuit 48 is stopped and the quantity of charges of the capacitive element C1 is reduced, the transistor TR2 is turned on. Accordingly, a conductive state is formed between the collector and the emitter of the transistor TR2, the transistor TR2 changes the connection path PL3 connecting the afterglow LEDs 12*a* and the normal lighting LEDs 12*b* to the open state from the closed state. By this operation of the transistor TR2, the keying circuit 49 switches the second power supply path PL2 to the closed state and the first power supply path PL1 to the open state.

Thus, as the reduction in quantity of charges of the capacitive element C1 is detected by the transistor TR1, the keying circuit 49 switches the second power supply path PL2 to the closed state and the first power supply path PL1 to the open state by changing the connection path PL3 to the open state from the closed state through the transistor TR2. By setting the opening and the closing state as described above, the current flows in the afterglow LEDs 12*a* without flowing into the normal lighting LEDs 12*b*. Further, the power supply to the afterglow LEDs 12*a* is performed by discharging the charges of the capacitive element C1 accumulated during the power supply from the constant current output circuit 48, to the second power supply path PL2 in the second state.

[Design Conditions of the Keying Circuit 49]

Hereinafter, description is made on design conditions of the keying circuit 49 including the resistance values of the first and the second resistive element and design conditions of the transistor TR1, and the like.

In general, a forward drop voltage of the LED is reduced with a temperature rise of the LED. Thus, when the LED is turned on, the forward drop voltage of the LED is reduced. In the present embodiment, it is requested for the forward drop voltage of the entire light emitting module 10 not to fall below an operating voltage of the transistor TR1. That is, it is necessary to satisfy a relationship as shown by Eq. 1.

$$(r_2/(r_1+r_2))\times N\times V_{fmin}>V_{TR1} \quad \text{(Eq. 1).}$$

In Eq. 1, $r_1$ and $r_2$ are the resistance values of the first resistive element R1 and the second resistive element R2, respectively. Also, N is the total number of the afterglow LEDs 12*a* and the normal lighting LEDs 12*b* which are connected in series, $V_{fmin}$ is the minimum forward drop voltage of the afterglow LEDs 12*a* and the normal lighting LEDs 12*b* and $V_{TR1}$ is the operating voltage of the transistor TR1.

In this case, Eq. 1 is a relational expression when assuming that LEDs having the same specification, i.e., the same forward drop voltage are used in the afterglow LEDs 12*a* and the normal lighting LEDs 12*b*. If LEDs having different specifications are used in the afterglow LEDs 12*a* and the normal light LEDs 12*b* and accordingly the forward drop voltages thereof is different from each other, it is preferable that the minimum forward drop voltage among the forward drop voltages of the LEDs is set to $V_{fmin}$.

Further, when providing the afterglow after the stopping the power supply from the external power source, it is requested to prevent the transistor TR1 from being turned on, i.e., to maintain the ON state of the transistor TR2. To this end, it is necessary for the forward drop voltage across the light emitting module 10 when providing the afterglow not to exceed the operating voltage of the transistor TR1. Thus, it is necessary to satisfy a relationship as shown by Eq. 2.

$$(r_2/(r_1+r_2))\times n\times V_{fmax}<V_{TR1} \quad \text{(Eq. 2).}$$

In Eq. 2, n is the number of the afterglow LEDs 12*a* connected in series and $V_{fmax}$ is the maximum forward drop voltage of the LED.

Summary of the First Embodiment

As described above, the illumination apparatus 1 according to the first embodiment of the present invention has the following features. That is, the illumination apparatus 1 includes the constant current output circuit 48, the capacitive element C1, the light emitting module 10 and the keying circuit 49. The constant current output circuit 48 is a power supply circuit. The capacitive element C1 is connected between the output terminals of the constant current output circuit 48. The light emitting module 10 is a light emitting unit including the afterglow LEDs 12*a* as first semiconductor light emitting elements and the normal lighting LEDs 12*b* as second semiconductor light emitting elements, which are connected in series and in parallel.

The keying circuit 49 is provided between the capacitive element C1 and the light emitting module 10, and electrically opens and closes the first power supply path PL1 and the second power supply path PL2. The first power supply path PL1 is a power supply path in which current passes through both the afterglow LEDs 12*a* and the normal lighting LEDs 12*b* from the capacitive element C1 or the constant current output circuit 48. The second power supply path PL2 is a power supply path in which current passes through the afterglow LEDs 12*a* from the capacitive element C1 without passing through the normal lighting LEDs 12*b*.

While power from the power supply circuit is being supplied, the keying circuit 49 is set in the first state in which the first power supply path PL1 is closed and the second power supply path PL2 is opened. Then, when the quantity of charges of the capacitive element C1 is reduced after the stop of the power supply from the power supply circuit, the keying circuit 49 is switched from the first state to the second state in which the first power supply path PL1 is opened and the second power supply path PL2 is closed.

In the illumination apparatus 1 according to the present embodiment, only the afterglow LEDs 12*a* in the series-connected bodies including the afterglow LEDs 12*a* and the normal lighting LEDs 12*b* connected in series are turned on and the light emitted from the afterglow LEDs 12*a* is used as the afterglow. That is, the current path is cut off in the middle of the series-connected bodies unlike the normal lighting, and only the LEDs located on the upstream side of the cut-off point are turned on.

With this configuration, unlike the conventional illumination apparatus in which one or more LEDs of one of series-connected bodies connected in parallel are used to provide the afterglow, the capacitive element is not required in order to turn on the one or more LEDs of the series-connected body. Accordingly, it is not necessary to separately provide the capacitive element for the afterglow. Thus, it is possible to reduce the number of capacitive elements which are relatively large in size among the circuit components. This makes it possible to reduce the size of the illumination apparatus.

Moreover, in the configuration in which a plurality of series-connected bodies, each including LEDs, are connected in parallel to each other, it is preferred that the series-connected bodies have uniform characteristics such as forward voltage-forward current characteristics. Accordingly, in the conventional example in which the number of LEDs included in the series-connected body used in both the normal lighting and the afterglow is limited to a certain extent by that of the series-connected body used only in the normal lighting. However, in the present embodiment, since some of the LEDs connected in series in the respective series-connected bodies are turned on and used to provide the afterglow, the number of the afterglow LEDs 12*a* can be determined relatively freely. Thus, duration and quantity of the afterglow can be flexibly determined.

[Others]

Color temperatures of the lights emitted from the afterglow LEDs 12*a* and the normal lighting LEDs 12*b* are not particularly limited. The color temperatures of the lights emitted from the afterglow LEDs 12*a* and the normal lighting LEDs 12*b* may be same or different. For example, when installing the illumination apparatus 1 in a bedroom, the color temperature of the light emitted from the afterglow LEDs 12*a* may be lower than the color temperature of the light emitted from the normal lighting LEDs 12*b*. Specifically, the emission color of the afterglow LEDs 12*a* may be set to, e.g., warm white, and the emission color of the normal lighting LEDs 12*b* may be set to, e.g., daylight.

In case of varying the color temperatures of the emitted lights, it is preferable that the number of one of the afterglow LEDs 12*a* and the normal lighting LEDs 12*b* is set to be much greater than the number of the other. By this setting, even when the color temperatures of the lights emitted from the afterglow LEDs 12*a* and the normal lighting LEDs 12*b* are different from each other, it is possible to reduce an influence on light distribution characteristics. Further, since the quantity of afterglow is generally set to be smaller than the quantity of light during normal lighting, it is more preferable that the number of the afterglow LEDs 12*a* is smaller than that of the normal lighting LEDs 12*b*.

Although it has been described that the number of the afterglow LEDs 12*a* can be set relatively freely, the numbers of the afterglow LEDs 12*a* and the normal lighting LEDs 12*b* are not particularly limited. The numbers of the afterglow LEDs 12*a* and the normal light LEDs 12*b* may be same or different. In addition, although it has been described that it is preferable that the number of the afterglow LEDs 12*a* is smaller than the number of the normal lighting LEDs 12*b* because the quantity of afterglow is more frequently set to be smaller than the quantity of light during normal lighting, it may be configured such that the number of the afterglow LEDs 12*a* is greater than that of the normal lighting LEDs 12*b* if necessary.

Second Embodiment

Figure 8:
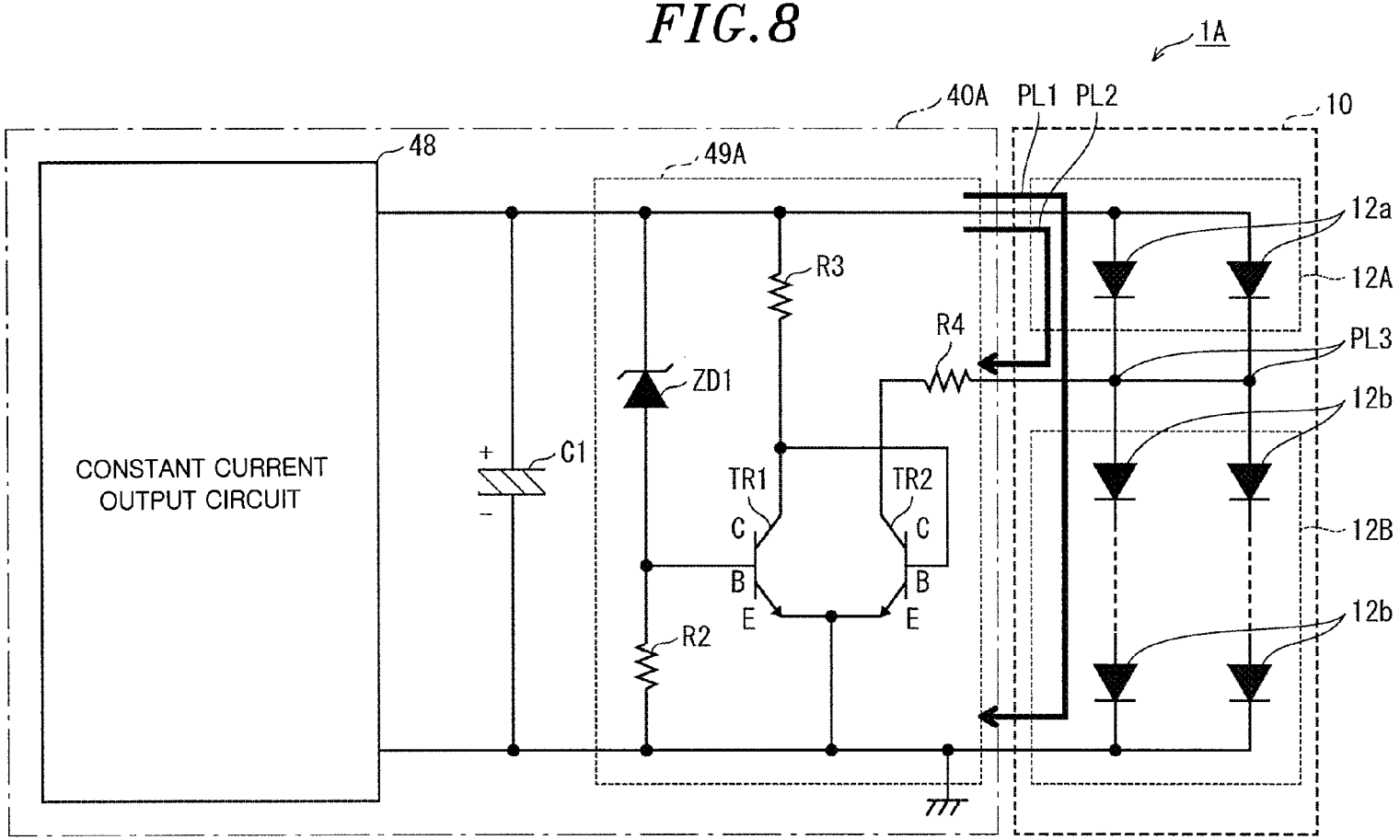
FIG. 8 is a diagram showing a circuit configuration of an illumination apparatus 1A according to another embodiment.

FIG. 8 is a diagram showing a circuit configuration of an illumination apparatus 1A according to a second embodiment. The illumination apparatus 1A includes the light emitting module 10 and a lighting circuit unit 40A. A difference from the illumination apparatus 1 according to the first embodiment is a configuration of a keying circuit 49A in the lighting circuit unit 40A. That is, the first resistive element R1 of the keying circuit 49 according to the first embodiment is replaced by a zener diode ZD1.

The operation of the keying circuit 49A is the same as that in the first embodiment. It can be described by replacing one end and the other end of the first resistive element R1 according to the first embodiment, respectively, with a cathode and an anode of the zener diode ZD1 in the keying circuit 49A. A connection relationship between circuit elements of the keying circuit 49A according to the present embodiment will be described briefly.

The cathode of the zener diode ZD1 is connected to the positive electrode of the capacitive element C1, and the anode of the zener diode ZD1 is connected to the control terminal of the transistor TR1. One end of the second resistive element R2 is connected to the anode of the zener diode ZD1, and the other end of the second resistive element R2 is connected to the ground. One end of the third resistive element R3 is connected to the positive electrode of the capacitive element C1, and the other end of the third resistive element R3 is connected to the collector of the transistor TR1. One end of the fourth resistive element R4 is connected to the connection path PL3, and the other end of the fourth resistive element R4 is connected to the collector of the transistor TR2.

Third Embodiment

In the illumination apparatus 1 according to the first embodiment, the detection unit and the opening and closing unit of the keying circuit 49 are realized by separate transistors, respectively, but are not limited thereto.

[Circuit Configuration]

Figure 9:
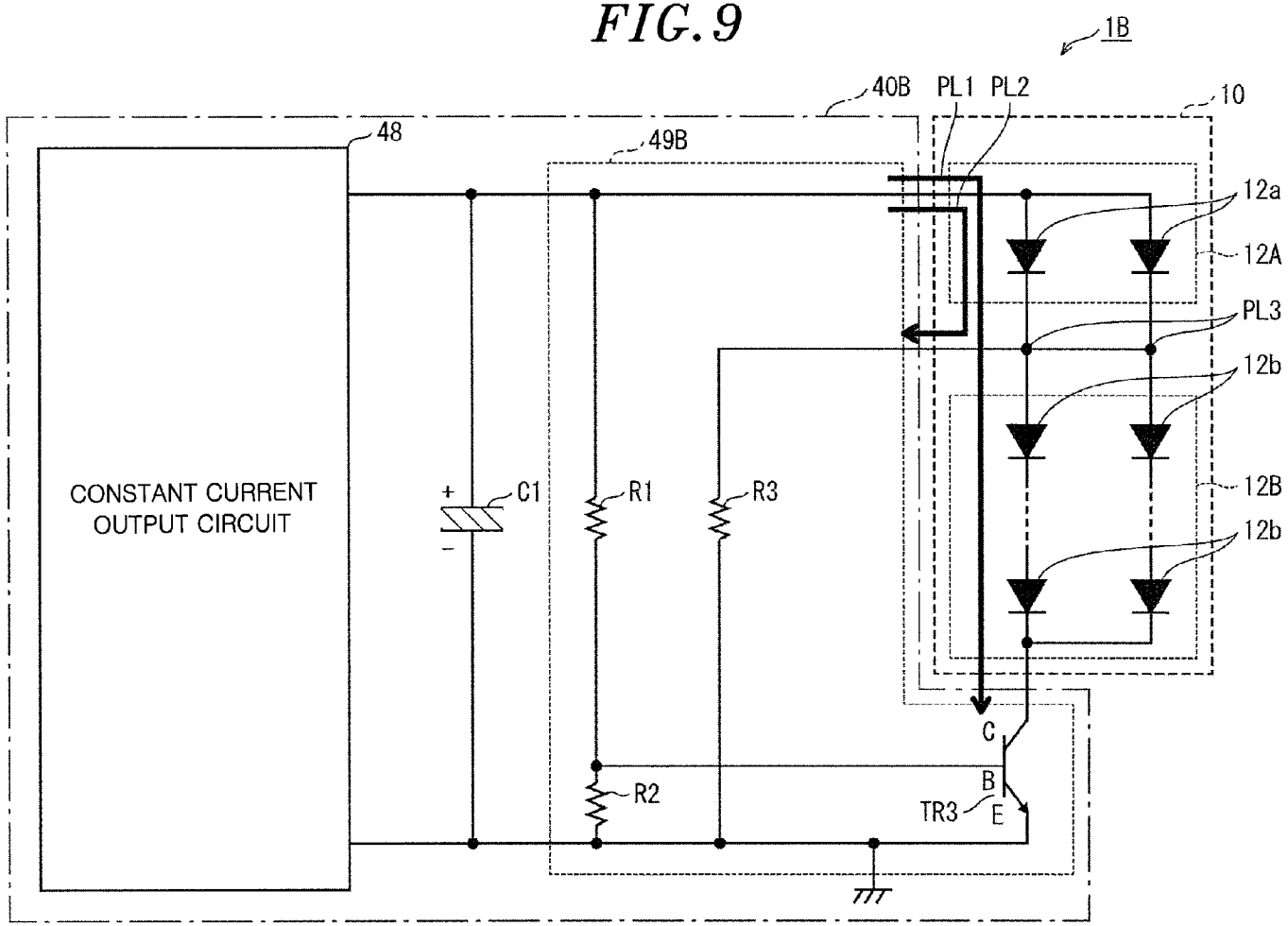
FIG. 9 is a diagram showing a circuit configuration of an illumination apparatus 1B according to still another embodiment.

FIG. 9 is a diagram showing a circuit configuration of an illumination apparatus 1B according to a third embodiment. The illumination apparatus 1B includes the light emitting module 10 and a lighting circuit unit 40B. A difference from the illumination apparatus 1 according to the first embodiment is a configuration of a keying circuit 49B in the lighting circuit unit 40B. The keying circuit 49B includes the first resistive element R1, the second resistive element R2, the third resistive element R3 and a transistor TR3.

One end of the first resistive element R1 is connected to the positive electrode of the capacitive element C1, and the other end of the first resistive element R1 is connected to the second resistive element R2 and a base of the transistor TR3. One end of the second resistive element R2 is connected to the other end of the first resistive element R1, and the other end of the second resistive element R2 is connected to the ground. One end of the third resistive element R3 is connected to the connection path PL3 connecting the afterglow LEDs 12*a* and the normal lighting LEDs 12*b*, and the other end of the third resistive element R3 is connected to the ground.

The transistor TR3 is an npn-type bipolar transistor, and its base is connected to the other end of the first resistive element R1, more specifically, a connection point between the first resistive element R1 and the second resistive element R2. A collector of the transistor TR3 is connected to the cathodes of the normal lighting LEDs 12*b* at the most downstream side of the series-connected bodies, and an emitter of the transistor TR3 is connected to the ground. The collector and the emitter of the transistor TR3 correspond to one and the other output terminal of the switching element.

[Operation]

When power supply to the illumination apparatus 1B from the external power source is started, first, the capacitive element C1 is charged by current from the constant current output circuit 48. When the capacitive element C1 is charged, the current flows to the base of the transistor TR3 through the first resistive element R1 and a base-emitter voltage of the transistor TR3 becomes a high level. Thus, the transistor TR3 is turned on and a conductive state is formed between the collector and the emitter of the transistor TR3. At this point, the first power supply path PL1 is in the closed state, the second power supply path PL2 is in the open state, and power is supplied to the afterglow LEDs 12*a* and the normal lighting LEDs 12*b*.

When the power supply to the illumination apparatus 1B from the external power source is stopped, the power supply to the capacitive element C1 from the constant current output circuit 48 is stopped. Accordingly, charges of the capacitive element C1 are discharged and the quantity of charges of the capacitive element C1 is reduced. Thus, the current flowing to the base of the transistor TR3 is reduced and the base-emitter voltage of the transistor TR3 becomes a low level. As a result, the transistor TR3 is turned off. Since a non-conductive state is formed between the collector and the emitter of the transistor TR3, the connection path PL3 is substantially switched to the open state from the closed state. As a result, the first power supply path PL1 is substantially in the open state, and the second power supply path PL2 is substantially in the closed state. Thus, the current flows in the afterglow LEDs 12*a*, but the current does not flow in the normal lighting LEDs 12*b*.

In the keying circuit 49B according to the present embodiment, the transistor TR3 functions as both the detection unit and the opening and closing unit. That is, the transistor TR3 is turned off as the quantity of charges of the capacitive element C1 is reduced. Further, with the transition from the ON state to the OFF state of the transistor TR3, the transistor TR3 switches the connection path PL3 substantially to the open state from the closed state.

[Modifications and Others]

The first to third embodiments have been described, but the present invention is not limited thereto. For example, modifications can be made as described below.

(1) In the above embodiments, examples of using bipolar transistors as the transistors TR1, TR2 and TR3 of the keying circuit have been described. The present invention is not limited thereto and as the transistors, an insulated gate bipolar transistor (IGBT), a static induction transistor (SIT), a gate injection transistor (GIT), or the like may be used.

In the case of using insulated gate bipolar transistors as the transistors TR1, TR2 and TR3, "base" in the description of the above embodiments is required to be replaced by "gate."

(2) In the above embodiments, an example of using npn-type bipolar transistors as the transistors TR1, TR2 and TR3 of the keying circuit has been described, but n-type field effect transistors may be used. The operation of the keying circuit in the case of using the n-type field effect transistors may be described similarly by replacing "base", "emitter" and "collector" in the embodiments with "gate", "source" and "drain", respectively.

Examples of the field effect transistor include a metal-insulator-semiconductor field effect transistor (MISFET), a metal-semiconductor field effect transistor (MESFET), a junction field effect transistor (JFET) and the like. Regarding the MISFET, oxide may be used as a gate insulating film, which is also referred to as a metal-oxide-semiconductor field effect transistor (MOSFET).

(3) In the above embodiments, the light emitting module serving as a light emitting unit is configured to include two series-connected bodies, each having afterglow LEDs and normal lighting LEDs connected in series, but the present invention is not limited thereto. The number of the series-connected bodies may be at least one, e.g., one or three or more.

(4) In the above embodiments, an example of using the light emitted from the afterglow LEDs as the afterglow after the stop of the power supply from the external power source has been described, but it is not limited thereto. For example, the light emitted from the afterglow LEDs may be used as an indirect light, nightlight, an emergency lamp to provide light even after a power failure, or the like.

Figure 10:
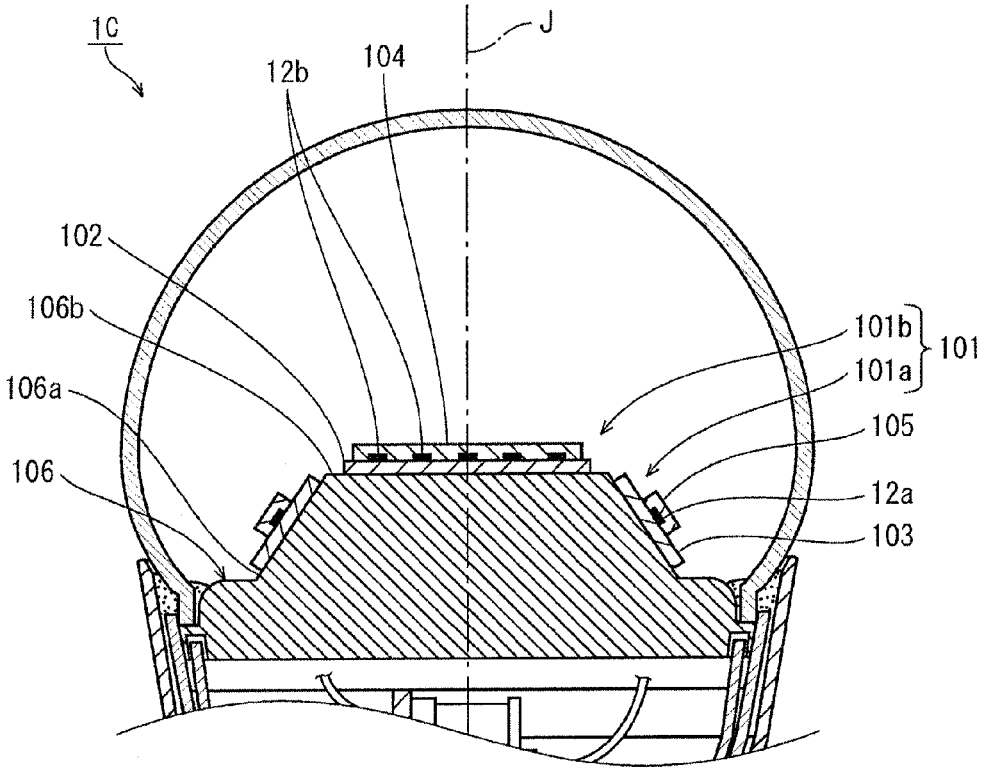
FIG. 10 is a partial longitudinal cross-sectional view of an illumination apparatus 1C according to a modification.

(5) The configuration of the LED lamp which is a replacement of an incandescent bulb, to which the present invention can be applied is not limited to that shown in the first embodiment. For example, in the first embodiment, the lighting circuit unit 40 is covered in triplicate by the circuit holder 50, the inner casing 60 and the outer casing 80, but the lighting circuit unit 40 may be covered doubly. Further, when the light emitted from the afterglow LEDs after the stop of the power supply from the external power source is used as an indirect light or nightlight, the configuration may be as follows. FIG. 10 is a partial longitudinal cross-sectional view of an illumination apparatus 1C according to a modification. Further, FIG. 11 is a plan view showing a light emitting module 101 of the illumination apparatus 1C according to the modification.

Figure 11:
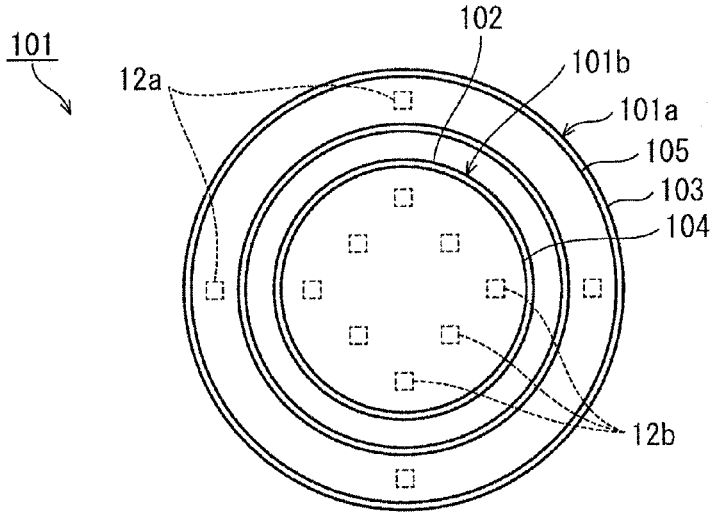
FIG. 11 is a plan view showing a light emitting module 101 according to a modification.
Figure 12:
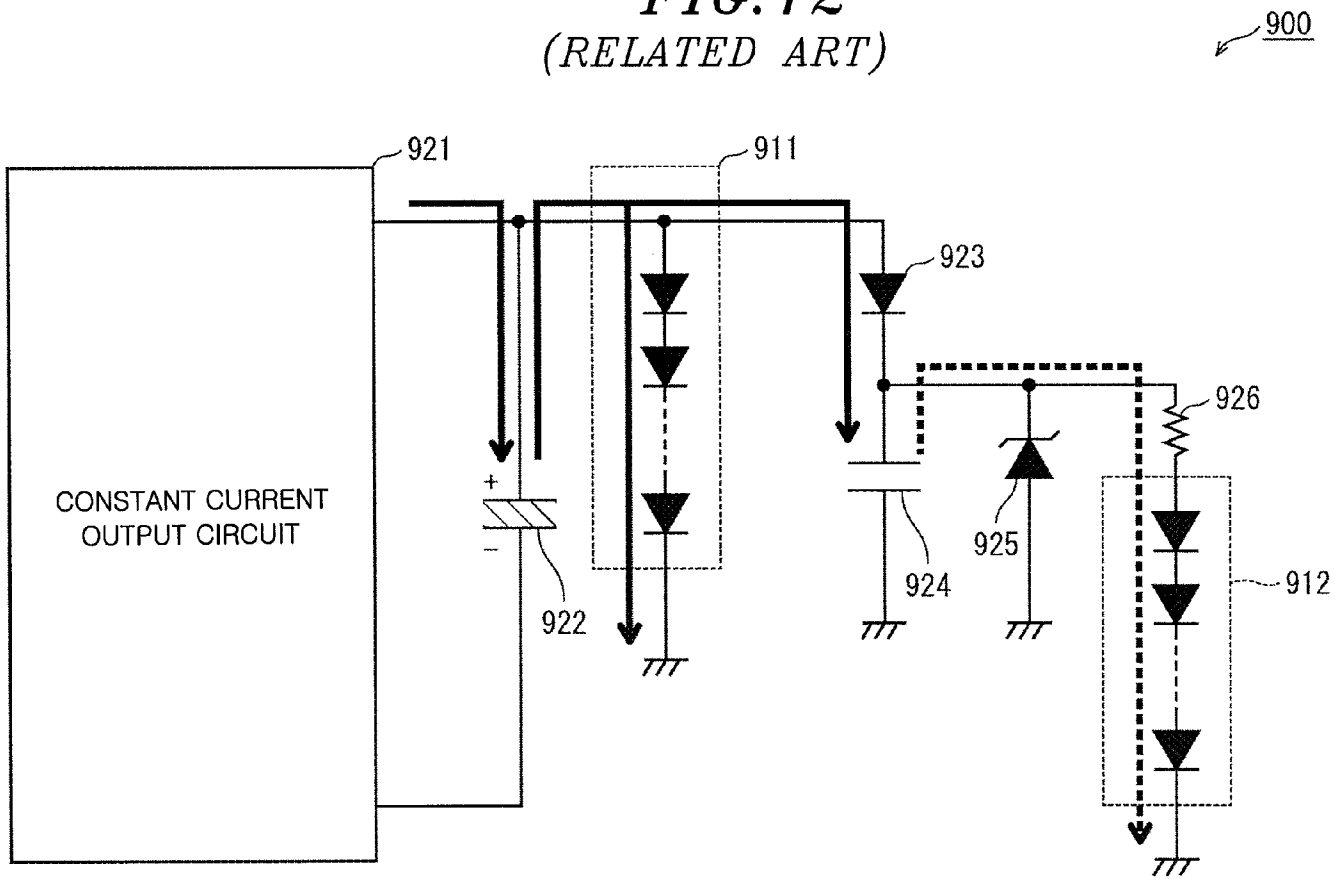
FIG. 12 (RELATED ART)
FIG. 12 is a diagram showing a circuit configuration of a conventional illumination apparatus 900.

As shown in FIGS. 10 and 11, the light emitting module 101 serving as a light emitting unit includes two sub-light emitting modules 101*a* and 101*b* mounted on a base 106. The sub-light emitting module 101*a* includes a mounting board 103, a plurality of afterglow LEDs 12*a* mounted on the mounting board 103, and a sealing member 105 covering the afterglow LEDs 12*a*. The sub-light emitting module 101*b* includes a mounting board 102, a plurality of normal light LEDs 12*b* mounted on the mounting board 102, and a sealing member 104 covering the normal lighting LEDs 12*b*. The afterglow LEDs 12*a* are connected in series, and the normal lighting LEDs 12*b* are also connected in series. Further, the afterglow LEDs 12*a* and the normal lighting LEDs 12*b* are also connected in series.

As shown in FIG. 11, the sub-light emitting module 101*a* has an annular shape to surround the sub-light emitting module 101*b* in a plan view. With this configuration, the afterglow LEDs 12*a* are arranged annularly so as to surround the normal lighting LEDs 12*b*. Further, the base 106 has an inclined portion 106*a* and an upper surface 106*b*. The sub-light emitting module 101*a* is mounted on the inclined portion 106*a* of the base 106, and the sub-light emitting module 101*b* is mounted on the upper surface 106*b* of the base 106. Thus, as shown in FIG. 11, a main emission direction of the afterglow LEDs 12*a* is oriented outwardly with respect to a virtual line J which extends in a main emission direction of the normal lighting LEDs 12*b*.

According to the present modification, by increasing the light quantity in the main emission direction during normal lighting, it is possible to provide a gentle light when it is used as an indirect light or nightlight. In this case, the number of the afterglow LEDs 12*a* and the number of the normal light LEDs 12*b* shown in FIGS. 10 and 11 are merely exemplary. For example, the number of the normal light LEDs 12*b* may be one in the case of using a large light quantity LED.

(6) The embodiments of the present invention can be applied to various types of illumination apparatuses without being limited to the LED lamp which is a replacement of an incandescent bulb.

(7) In the above embodiments, the LED has been illustrated as an example of semiconductor light emitting elements, but the present invention is not limited thereto. Besides the LED, for example, a laser diode (LD) or an electric luminescence (EL) element may be used. Further, these light sources may be used in combination.

(8) In the above embodiments, the semiconductor light emitting elements are mounted on the upper surface of the mounting board by using chip-on-board (COB) technology, but the present invention is not limited thereto. For example, it may be implemented by using surface-mount-device (SMD) type elements.

(9) In the above embodiments, white light is obtained by using blue LEDs as semiconductor light emitting elements, and yellow phosphor particles as a wavelength conversion material, but the present invention is not limited thereto. The wavelength conversion material may be a combination of green phosphor particles and red phosphor particles. Further, the ultraviolet emission color of the LEDs may be used as semiconductor light emitting elements, and three types of red phosphor particles, green phosphor particles and blue phosphor particles may be used as the wavelength conversion material. Further, in case of using three types of red, green and blue LEDs, white light may be obtained by mixing the emission colors thereof. In addition, the emission color is not limited to white, and may be another light color.

(10) The materials, numerical values and the like used in the above embodiments are merely preferred examples, and are not limited thereto. Further, various modifications are possible within the technical spirit and scope of the present invention. In addition, combinations of the embodiments can be made possible as long as no conflict arises. Furthermore, each drawing is a schematic diagram and may not have been illustrated precisely, and the scale of each member in the drawings is different from the actual scale While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. An illumination apparatus comprising:

a power supply circuit;

a capacitive element connected between output terminals of the power supply circuit;

a light emitting unit including at least one first semiconductor light emitting element and at least one second semiconductor light emitting element connected with the at least one first semiconductor light emitting element in series; and a keying circuit provided between the capacitive element and the light emitting unit and configured to electrically open or close a first power supply path which passes through both the at least one first semiconductor light emitting element and the at least one second semiconductor light emitting element from the power supply circuit or the capacitive element, and a second power supply path which passes through the at least one first semiconductor light emitting element without passing through the at least one second semiconductor light emitting element from the capacitive element, wherein the keying circuit is set in a first state in which the first power supply path is electrically closed and the second power supply path is electrically opened while a power from the power supply circuit is being supplied, and is set in a second state in which the first power supply path is electrically opened and the second power supply path is electrically closed when a reduction in quantity of charges of the capacitive element is detected after the power supplied from the power supply circuit is stopped.

2. The illumination apparatus of claim 1, wherein the keying circuit comprises a detection unit configured to detect the reduction in quantity of charges of the capacitive element, and a state selection unit configured to electrically open or close at least one electrical connection path provided between the at least one first semiconductor light emitting element and the at least one second semiconductor light emitting element, and wherein as the reduction in quantity of charges is detected by the detection unit, the state selection unit changes the electrical connection path from a closed state to a open state to switch the keying circuit from the first state to the second state.

3. The illumination apparatus of claim 2, wherein the detection unit comprises a first switching element whose control terminal is connected to a positive electrode of the capacitive element and which is turned off with the reduction in quantity of charges of the capacitive element, and wherein the state selection unit comprises a second switching element including a control terminal connected to the positive electrode of the capacitive element and a terminal connected to the electrical connection path, and which is turned on with transition from a conduction state to a non-conduction state of the first switching element.

4. The illumination apparatus of claim 3, wherein the positive electrode of the capacitive element is connected to a terminal of the first switching element and the control terminal of the second switching element.

5. The illumination apparatus of claim 3, wherein the first switching element is one of an npn-type bipolar transistor whose collector is connected to the positive electrode of the capacitive element and whose emitter is connected to a ground, and an n-type field effect transistor whose drain is connected to the positive electrode of the capacitive element and whose source is connected to the ground, and wherein the second switching element is one of an npn-type bipolar transistor whose collector is connected to the electrical connection path and whose emitter is connected to the ground, and an n-type field effect transistor whose drain is connected to the electrical connection path and whose source is connected to the ground.

6. The illumination apparatus of claim 3, wherein the keying circuit further comprises:

a first resistive element having one end connected to the positive electrode of the capacitive element and the other end connected to the control terminal of the first switching element;

a second resistive element having one end connected to the other end of the first resistive element and the other end connected to a ground;

a third resistive element having one end connected to the positive electrode of the capacitive element and the other end connected to a terminal of the first switching element; and a fourth resistive element provided between the electrical connection path and the terminal of the second switching element.

7. The illumination apparatus of claim 6, wherein the at least one first semiconductor light emitting element and the at least one second semiconductor light emitting element have the same forward drop voltage, and wherein when a resistance value of the first resistive element is $r_1$, a resistance value of the second resistive element is $r_2$, the total number of the at least one first semiconductor light emitting element and the at least one second semiconductor light emitting element which are connected in series is N, a minimum forward drop voltage of the at least one first semiconductor light emitting element and the at least one second semiconductor light emitting element is $V_{fmin}$, and an operating voltage of the first switching element is $V_{TR1}$, in case of the first power supply path, a relationship of $(r_2/(r_1+r_2)\times N\times V_{fmin}>V_{TR1}$ is satisfied.

8. The illumination apparatus of claim 6, wherein the at least one first semiconductor light emitting element and the at least one second semiconductor light emitting element have the same forward drop voltage, and wherein when a resistance value of the first resistive element is $r_1$, a resistance value of the second resistive element is $r_2$, the number of the at least one first semiconductor light emitting element is n, and a maximum forward drop voltage of the at least one first semiconductor light emitting element is $V_{fmax}$, in case of the second power supply path, a relationship of $(r_2/(r_1+r_2))\times n\times V_{fmax}<V_{TR1}$ is satisfied.

9. The illumination apparatus of claim 3, wherein the keying circuit further comprises a zener diode having a cathode connected to the positive electrode of the capacitive element and an anode connected to the control terminal of the first switching element;

a first resistive element having one end connected to the anode of the zener diode and the other end connected to ground;

a second resistive element having one end connected to the positive electrode of the capacitive element and the other end connected to a terminal of the first switching element; and a third resistive element provided between the electrical connection path and the terminal of the second switching element.

10. The illumination apparatus of claim 2, wherein in the keying circuit, the detection unit also serves as the state selection unit, wherein the keying circuit further comprises:

a first resistive element having one end connected to the positive electrode of the capacitive element;

a switching element whose first terminal serving as a control terminal is connected to the other end of the first resistive element, whose second terminal is connected to a cathode of the second semiconductor light emitting element which is arranged at the most downstream of the first power supply path, and whose third terminal is connected to a ground;

a second resistive element having one end connected to the other end of the first resistive element and the other end connected to the ground; and a third resistive element having one end connected to the electrical connection path and the other end connected to the ground, and wherein the switching element is turned off with the reduction in quantity of charges of the capacitive element, and the electrical connection path is changed from the closed state to the open state with transition from a conduction state to a non-conduction state of the switching element.

11. The illumination apparatus of claim 1, wherein the number of the at least one first semiconductor light emitting element is different from the number of the at least one second semiconductor light emitting element.

12. The illumination apparatus of claim 1, wherein the number of the at least one first semiconductor light emitting element is smaller than the number of the at least one second semiconductor light emitting element.

13. The illumination apparatus of claim 1, wherein a color temperature of light emitted from the at least one first semiconductor light emitting element is different from a color temperature of light emitted from the at least one second semiconductor light emitting element.

14. The illumination apparatus of claim 1, wherein the at least one first semiconductor light emitting element includes a plurality of first semiconductor light emitting elements connected in series, wherein the plurality of first semiconductor light emitting elements are arranged annularly to surround the at least one second semiconductor light emitting element, and wherein a main emission direction of the plurality of first semiconductor light emitting elements is oriented outwardly with respect to a virtual line which extends in a main emission direction of the at least one second semiconductor light emitting elements.

15. The illumination apparatus of claim 1, wherein the at least one first semiconductor light emitting element includes a plurality of first semiconductor light emitting elements connected in series and the at least one second semiconductor light emitting element includes a plurality of second semiconductor light emitting elements connected in series, wherein the plurality of first semiconductor light emitting elements are arranged annularly to surround the plurality of second semiconductor light emitting elements, and wherein a main emission direction of the plurality of first semiconductor light emitting elements is oriented outwardly with respect to a virtual line which extends in a main emission direction of the plurality of second semiconductor light emitting elements.

16. A lighting circuit of an illumination apparatus using a light emitting unit including at least one first semiconductor light emitting element and at least one second semiconductor light emitting element connected with the at least one first semiconductor light emitting element in series as a light source, the lighting circuit comprising:

a power supply circuit;

a capacitive element connected between output terminals of the power supply circuit; and a keying circuit provided between the capacitive element and the light emitting unit and configured to electrically open or close a first power supply path which passes through both the at least one first semiconductor light emitting element and the at least one second semiconductor light emitting element from the power supply circuit or the capacitive element, and a second power supply path which passes through the at least one first semiconductor light emitting element without passing through the at least one second semiconductor light emitting element from the capacitive element, wherein the keying circuit is set in a first state in which the first power supply path is electrically closed and the second power supply path is electrically opened while a power from the power supply circuit is being supplied, and is set in a second state in which the first power supply path is electrically opened and the second power supply path is electrically closed when a reduction in quantity of charges of the capacitive element is detected after the power supplied from the power supply circuit is stopped.

* * * * *